US009963768B2

(12) United States Patent
Yi et al.

(10) Patent No.: US 9,963,768 B2
(45) Date of Patent: May 8, 2018

(54) METHOD FOR MANUFACTURING AMORPHOUS ALLOY BY USING LIQUID PIG IRON

(75) Inventors: Sang-Ho Yi, Pohang-shi (KR); Seung Dueg Choi, Pohang-shi (KR); Seong Hoon Yi, Daegu (KR)

(73) Assignee: POSCO, Pohang-si (KR)

( * ) Notice: Subject to any disclaimer, the term of this patent is extended or adjusted under 35 U.S.C. 154(b) by 1214 days.

(21) Appl. No.: 13/142,916

(22) PCT Filed: Dec. 28, 2009

(86) PCT No.: PCT/KR2009/007833

§ 371 (c)(1),
(2), (4) Date: Aug. 2, 2011

(87) PCT Pub. No.: WO2010/077040

PCT Pub. Date: Jul. 8, 2010

(65) Prior Publication Data

US 2012/0167717 A1 Jul. 5, 2012

(30) Foreign Application Priority Data

Dec. 30, 2008 (KR) ..... 10-2008-0136548

(51) Int. Cl.
*C22C 33/00* (2006.01)
*B22F 9/00* (2006.01)
(Continued)

(52) U.S. Cl.
CPC ..... *C22C 45/02* (2013.01); *C22C 1/02* (2013.01); *C22C 33/003* (2013.01); *B22F 3/00* (2013.01)

(58) Field of Classification Search
CPC .. B22F 8/00; B22F 2301/35; B22F 2301/355; B22F 2999/00; C21D 2201/03; C22C 1/022; C22C 1/02; C22C 2200/02
(Continued)

(56) References Cited

U.S. PATENT DOCUMENTS 2,149,480 A * 3/1939 Paschke ..... C21B 5/02 75/459
3,125,442 A * 3/1964 Alexander ..... C22C 37/00 148/322
(Continued)

FOREIGN PATENT DOCUMENTS

CN 1448529 A 11/2012
GB 981712 * 1/1965
(Continued)

OTHER PUBLICATIONS

Kendall et al. (Bela G. Liptak, editor), Instrument Engineers' Handbook, Fourth ed., Process Control and Optimization, vol. 2, "Chemical Reactors: Basic Control Strategies," Ch. 8.9 2006, pp. 1664-1696.*
(Continued)

*Primary Examiner* — Roy King
*Assistant Examiner* — Vanessa T Luk
(74) *Attorney, Agent, or Firm* — The Webb Law Firm

(57) ABSTRACT

A method for manufacturing an amorphous alloy by using liquid pig iron is described. An exemplary embodiment provides a method for manufacturing an amorphous alloy, including providing liquid pig iron, adding an alloy material to the liquid pig iron, and solidifying the liquid pig iron.

7 Claims, 1 Drawing Sheet

(51) Int. Cl.
*C22C 45/02* (2006.01)
*C22C 1/02* (2006.01)
*B22F 3/00* (2006.01)

(58) Field of Classification Search
USPC ..... 75/331–341, 343, 351–361, 392–412, 75/433–584, 10.63, 10.1; 148/561, 403; 420/129
See application file for complete search history.

(56) References Cited

U.S. PATENT DOCUMENTS

| | | | | | |
|---|---|---|---|---|---|
| 4,358,313 | A | * | 11/1982 | Yoshii et al. | 75/511 |
| 4,473,401 | A | * | 9/1984 | Masumoto et al. | 148/403 |
| 4,505,745 | A | * | 3/1985 | Hamada | C22C 33/06 148/403 |
| 4,602,948 | A | * | 7/1986 | Singhal | 420/121 |
| 4,602,951 | A | * | 7/1986 | Singhal | 420/117 |
| 4,741,771 | A | * | 5/1988 | Palchetti et al. | 75/563 |
| 5,322,113 | A | | 6/1994 | Shibuya et al. | |
| 7,704,450 | B2 | | 4/2010 | Takeuchi et al. | |
| 2003/0183041 | A1 | * | 10/2003 | Takeuchi et al. | 75/10.63 |
| 2006/0124208 | A1 | * | 6/2006 | Coe | C22C 33/04 148/546 |
| 2007/0295429 | A1 | * | 12/2007 | Yi et al. | 148/403 |
| 2009/0277304 | A1 | * | 11/2009 | Ogawa et al. | 75/526 |

FOREIGN PATENT DOCUMENTS

| | | | | | |
|---|---|---|---|---|---|
| JP | 55140767 | A | * | 11/1980 | |
| JP | S5938353 | A | | 3/1984 | |
| JP | H01255644 | A | | 10/1989 | |
| JP | 5059483 | A | | 3/1993 | |
| JP | 2003286534 | A | | 10/2003 | |
| JP | 2007277677 | A | | 10/2007 | |
| JP | 2008520832 | A | | 6/2008 | |
| KR | 1020030078723 | A | | 10/2003 | |
| KR | 1020080057755 | A | | 6/2008 | |
| WO | WO 2007/119806 | | * | 10/2007 | C21C 7/00 |

OTHER PUBLICATIONS

"Glossary of Metallurgical and Metalworking Terms," Metals Handbook, ASM International, 2002, term(s): tapping.*

"Glossary of Metallurgical and Metalworking Terms," Metals Handbook, ASM International, 2002, term(s): pig iron.*

Hongxiang Li, Thesis for the Degree of Doctor of Engineering, "Preparation, Glass Forming Ability and Properties of Fe-based Bulk Metallic Glasses in the Alloy System Fe—C—Si—B—P—M (M= Metallic Elements)", Dec. 2007, 179 pp.

Seonghoon Yi et al., "Fabrication of Fe-Based Bulk Amorphous Alloys Using Hot Metal and Commercial Ferro-Alloys", Materials Transactions, vol. 46, No. 10 (2005) pp. 2237-2240.

* cited by examiner

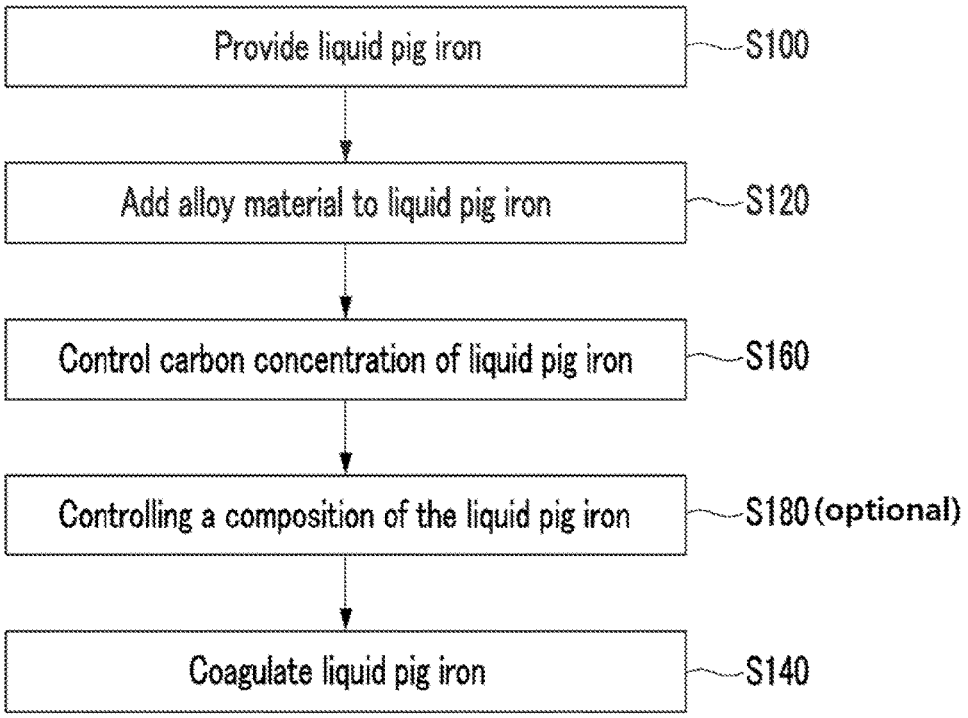
Provide liquid pig iron
S100
Add alloy material to liquid pig iron
S120
Control carbon concentration of liquid pig iron
S160
Controlling a composition of the liquid pig iron
S180 (optional)
Coagulate liquid pig iron
S140

METHOD FOR MANUFACTURING AMORPHOUS ALLOY BY USING LIQUID PIG IRON

CROSS-REFERENCE TO RELATED APPLICATION

This application claims priority to and the benefit of Korean Patent Application No. 10-2008-0136548 filed in the Korean Intellectual Property Office on Dec. 30, 2008, the entire contents of which are incorporated herein by reference.

BACKGROUND OF THE INVENTION (a) Field of the Invention

The present invention relates to a method for manufacturing an amorphous alloy, and more particularly, to a method for manufacturing an amorphous alloy by using liquid pig iron in a large amount.

(b) Description of the Related Art

In general, in order to manufacture an amorphous alloy, an alloy material including a desired component should be added. However, a conventional process is suitable for manufacturing products in a small amount, but is not suitable for mass production.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a method for manufacturing an amorphous alloy by using liquid pig iron in a large amount.

An exemplary embodiment of the present invention provides a method for manufacturing an amorphous alloy, including: providing liquid pig iron; adding an alloy material to the liquid pig iron; and solidifying the liquid pig iron.

The method may further include, between the adding of the alloy material and the solidifying of the liquid pig iron, controlling a carbon concentration of the liquid pig iron. The controlling of the carbon concentration of the liquid pig iron may be performed in any one of a metal mixer, an electric furnace, and a converter, or in a desulfurization process. In the controlling of the carbon concentration of the liquid pig iron, a gas or solid oxide may be provided to the liquid pig iron. The gas may be at least one of gas selected from the group consisting of pure oxygen, a gas mixture including oxygen, and air, and the solid oxide may include iron oxide or manganese oxide.

In the controlling of the carbon concentration of the liquid pig iron, a low carbon scrap or a deoxidized ingot steel may be added to the liquid pig iron.

The method may further include, between the adding of the alloy material and the solidifying of the liquid pig iron, increasing the temperature of the liquid pig iron. The method may further include, after the increasing of the temperature, controlling a composition of the liquid pig iron. In the controlling of a composition of the liquid pig iron, the alloy material may be further added to the liquid pig iron.

In the adding of the alloy material, the alloy material may be added while the liquid pig iron is tapped, and the alloy material may be added while being included in alloy iron or a scrap. The alloy material may be at least one material selected from the group consisting of Fe—Si, Fe—P, and Fe—B. In addition, the alloy material may be at least one material selected from the group consisting of an oxide, a nitride, and a sulfide.

The solidifying of the liquid pig iron may include a powder manufacturing process or a fiber manufacturing process.

According to exemplary embodiments of the present invention, it is possible to manufacture an amorphous alloy by using a liquid pig iron in a large amount.

BRIEF DESCRIPTION OF THE DRAWING

FIG. 1 is a flowchart that illustrates a method for manufacturing an amorphous alloy according to an exemplary embodiment of the present invention.

DETAILED DESCRIPTION OF THE EMBODIMENTS

Exemplary embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is a flowchart that illustrates a method for manufacturing an amorphous alloy according to an exemplary embodiment of the present invention.

Referring to FIG. 1, the method for manufacturing the amorphous alloy includes providing liquid pig iron (S100), adding an alloy material to the liquid pig iron (S120), and solidifying the liquid pig iron (S140).

In step S100, the liquid pig iron is manufactured through a FINEX process, or the liquid pig iron is manufactured by a liquid pig iron manufacturing process such as a blast furnace.

In step S120, an alloy element is added by adding an alloy material (Fe—Si, Fe—P, and Fe—B) or scrap that corresponds to a component system of a required amorphous alloy to the liquid pig iron while the liquid pig iron is received in a vessel such as a torpedo car or a ladle. Meanwhile, the alloy element may be added by adding an oxide, nitride, or sulfide including the alloy element.

Since the melting temperature of the liquid pig iron is about 1150° C. and carbon (C) is saturated in the liquid pig iron, silicon (Si), boron (B), or phosphorus (P) that is an alloy element having a lower oxidation tendency than carbon may be desirably added thereto. That is, in the case where silicon (Si), boron (B), or phosphorus (P) is added to the liquid pig iron under an air atmosphere, silicon (Si), boron (B), or phosphorus (P) may be easily added thereto while an oxidation loss is minimized under the low oxygen partial pressure atmosphere formed by saturated carbon.

Meanwhile, the reduction efficiency is maximized by fall agitation strength generated in the course of falling of the liquid pig iron into the vessel and a sensible heat of the liquid pig iron. In this case, the generated oxidation heat promotes an alloying reaction of the liquid pig iron and increases the temperature of the liquid pig iron.

In step S140, the amorphous alloy is manufactured by solidifying the liquid pig iron. The liquid pig iron having the target composition is solidified through a powder manufacturing process or a fiber manufacturing process, and is finally changed into the amorphous alloy.

Meanwhile, between step S120 and step S140, the method may further include controlling a carbon concentration of the liquid pig iron (S160).

In step S160, the carbon concentration of the liquid pig iron is controlled by providing a gas or solid oxide to the liquid pig iron. Step S160 may be implemented in any one of a metal mixer, an electric furnace, and a converter, or in a desulfurization process.

In the case where step S160 is implemented in the metal mixer, the liquid pig iron is moved by being put in a torpedo car or a ladle, and provided into the metal mixer. The gas or solid oxide is provided through a nozzle, and the nozzle may be attached to a bottom or a side of the metal mixer. The gas or solid oxide may be provided through a nozzle that extends from an upper part of the metal mixer to a lower part thereof.

In the case where step S160 is performed with the desulfurization process, the gas or solid oxide may be provided through a nozzle mounted on an agitator for desulfurization.

In the case where step S160 is performed in the electric furnace (or converter), the gas or solid oxide may be provided through a nozzle attached to the bottom or the side of the electric furnace (or converter). The gas or solid oxide may be provided through a nozzle that extends from an upper part of the metal mixer to a lower part thereof.

The gas may include pure oxygen, a gas mixture including oxygen, or air, and the solid oxide may include iron oxide or manganese oxide.

If the solid oxide is added in order to control the carbon concentration, oxidation heat is generated, thereby promoting an alloying reaction and increasing the temperature of the liquid pig iron. The carbon concentration may be controlled by adding low carbon scrap or deoxidized ingot steel to the liquid pig iron.

In addition, after step S160, the method may further include controlling a composition of the liquid pig iron (S180).

In step S180, the target composition of the liquid pig iron is reached. If necessary, after the temperature of the liquid pig iron is increased, the target composition may be reached by adding the alloy material. In step S180, the same matter as the alloy material used in step S100 may be used. In the case where step S180 is performed in the metal mixer, when shaking the metal mixer, the alloy material may be well dissolved and the alloying efficiency may be increased. In step S180, it is possible to manufacture a high quality amorphous alloy without following next steel manufacturing process by appropriately controlling the composition of the alloy element.

In addition, after the conversion process, various inclusion induced defects caused by the deoxidization process may be retroactively prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing an amorphous alloy, comprising:

tapping liquid pig iron that is provided directly from an iron-making apparatus in its liquid form into a vessel;

adding an alloy material to the liquid pig iron during tapping;

reducing a carbon concentration of the liquid pig iron after the addition of the alloy material; and solidifying the alloyed liquid pig iron, wherein the alloy material is at least one material selected from the group consisting of Fe—Si, Fe—P, Fe—B, an oxide, a nitride, and a sulfide and the carbon concentration is reduced by the addition of a material selected from the group consisting of iron oxide, manganese oxide, low carbon scrap, and deoxidized ingot steel.

2. The method of claim 1, wherein reducing the carbon concentration of the liquid pig iron is performed in a desulfurization process or in any one of a metal mixer, an electric furnace, and a converter.

3. The method of claim 1, wherein after adding the alloy material and before solidifying the alloyed liquid pig iron the temperature of the liquid pig iron is increased.

4. The method of claim 3, wherein after increasing the temperature, a composition of the liquid pig iron is controlled.

5. The method of claim 4, wherein the composition of the liquid pig iron is controlled by adding additional alloy material to the already alloyed liquid pig iron.

6. The method of claim 1, wherein solidifying of the liquid pig iron includes a powder manufacturing process.

7. The method of claim 1, wherein solidifying of the liquid pig iron includes a fiber manufacturing process.

* * * * *